US012247464B2

(12) United States Patent
Fripp et al.

(10) Patent No.: US 12,247,464 B2
(45) Date of Patent: Mar. 11, 2025

(54) METAL-MATRIX DOWNHOLE SAND SCREENS

(71) Applicant: Halliburton Energy Services, Inc., Houston, TX (US)

(72) Inventors: Michael Linley Fripp, Houston, TX (US); Stephen Michael Greci, Houston, TX (US); Daniel D. Gleitman, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/367,901

(22) Filed: Sep. 13, 2023

(65) Prior Publication Data

US 2023/0417128 A1 Dec. 28, 2023

Related U.S. Application Data

(62) Division of application No. 17/658,178, filed on Apr. 6, 2022, now Pat. No. 11,788,386.

(60) Provisional application No. 63/188,289, filed on May 13, 2021.

(51) Int. Cl.
*E21B 43/08* (2006.01)

(52) U.S. Cl.
CPC ..... *E21B 43/084* (2013.01)

(58) Field of Classification Search
CPC ..... E21B 43/084
See application file for complete search history.

(56) References Cited

U.S. PATENT DOCUMENTS 2,985,241 A * 5/1961 Hanslip ..... E21B 43/084 166/230
4,064,938 A * 12/1977 Fast ..... B01D 29/48 166/236
5,295,538 A * 3/1994 Restarick ..... E21B 43/10 166/228
5,500,174 A * 3/1996 Scott ..... B01D 29/111 264/126

(Continued)

FOREIGN PATENT DOCUMENTS

KR 101309546 B1 9/2013
RU 2017108671 A 9/2018
WO 2019055166 A1 3/2019

OTHER PUBLICATIONS

Search Report and Written Opinion issued for International Patent Application No. PCT/US2022/071572, dated Jul. 14, 2022.

(Continued)

*Primary Examiner* — Robert E Fuller
*Assistant Examiner* — Neel Girish Patel
(74) *Attorney, Agent, or Firm* — The Hilton Firm PLLC

(57) ABSTRACT

A screen assembly for wellbore production wherein a base pipe is wrapped with a screen constructed one or more cables formed from a plurality of non-metallic fibers bonded to one another with a metal binder. The non-metallic fibers may be basalt fibers or another ceramic material. The metal binder forms a metal matrix that has a first diameter about a primary cable axis, with the metal matrix securing the non-metallic fibers so that they have a second diameter about the primary cable axis, where the second diameter is larger than the first diameter, minimizing exposure of the metal matrix to wellbore fluids.

20 Claims, 7 Drawing Sheets

(56) References Cited

U.S. PATENT DOCUMENTS 5,823,260 A * 10/1998 McConnell ..... B01D 39/2082 166/230
5,901,789 A * 5/1999 Donnelly ..... E21B 43/103 166/207
6,006,829 A * 12/1999 Whitlock ..... B01D 29/58 166/228
6,158,507 A * 12/2000 Rouse ..... E21B 43/084 166/228
6,528,157 B1 * 3/2003 Hussain ..... E21B 43/04 428/407
7,510,011 B2 3/2009 Le Gloahec et al.
8,875,784 B2 11/2014 Kuo et al.
9,650,850 B2 5/2017 Jamison et al.
10,043,600 B1 * 8/2018 Shangguan ..... E21B 43/128
2002/0175120 A1 * 11/2002 Norell ..... B01D 29/012 210/488
2003/0173075 A1 * 9/2003 Morvant ..... E21B 43/08 166/236
2004/0261994 A1 * 12/2004 Nguyen ..... E21B 43/103 166/227
2005/0023002 A1 * 2/2005 Zamora ..... D04C 1/06 166/380
2008/0053922 A1 * 3/2008 Honsinger ..... B01J 20/3212 210/508
2008/0209710 A1 * 9/2008 Ferguson ..... E21B 43/08 29/447
2009/0078403 A1 * 3/2009 Langlais ..... E21B 43/084 166/56
2009/0145610 A1 * 6/2009 Varkey ..... E21B 47/001 166/308.1
2010/0051270 A1 * 3/2010 Dusterhoft ..... E21B 43/082 166/227
2013/0004664 A1 * 1/2013 Agrawal ..... E21B 43/12 427/192
2013/0206393 A1 8/2013 Kuo et al.
2013/0206406 A1 * 8/2013 Kuo ..... E21B 43/082 166/278
2014/0158295 A1 * 6/2014 Badrak ..... E21B 43/088 427/249.1
2015/0034301 A1 * 2/2015 Kuo ..... E21B 43/088 166/227
2015/0152716 A1 * 6/2015 Kim ..... E21B 43/084 166/244.1
2016/0067826 A1 * 3/2016 Xu ..... B22F 3/11 219/76.12
2016/0122618 A1 * 5/2016 Nguyen ..... C04B 28/021 507/104
2016/0160615 A1 * 6/2016 Greci ..... E21B 43/04 166/227
2016/0168960 A1 * 6/2016 Wetzel, Jr. ..... E21B 43/08 166/250.01
2017/0204709 A1 * 7/2017 Weathers ..... E21B 43/084
2017/0362922 A1 * 12/2017 Lazo ..... E21B 43/08
2017/0365375 A1 * 12/2017 Holzmueller ..... H01B 13/24
2018/0016885 A1 * 1/2018 Collins ..... C09K 8/70
2018/0229469 A1 * 8/2018 Zhao ..... C04B 35/76
2018/0238150 A1 * 8/2018 Davis ..... E21B 43/088
2018/0252051 A1 * 9/2018 Coleman ..... E21B 43/12
2018/0266219 A1 9/2018 Coffin et al.

OTHER PUBLICATIONS

Search Report mailed Jul. 10, 2024 in Danish Patent Application No. PA 2023 030228.

* cited by examiner

METAL-MATRIX DOWNHOLE SAND SCREENS

CROSS REFERENCE TO RELATED APPLICATIONS

This application is a divisional of U.S. patent application Ser. No. 17/658,178, filed on Apr. 6, 2022 entitled "Metal-Matrix Downhole Sand Screens," which claims priority to U.S. Provisional Application No. 63/188,289, filed May 13, 2021, entitled "Metal-Matrix Downhole Sand Screens," the disclosure of which is incorporated herein by reference.

TECHNICAL FIELD

The present disclosure generally relates to oilfield equipment and, in particular, to downhole tools, hydrocarbon production and related systems having downhole screen assemblies. More particularly still, the present disclosure relates to sand screens and methods of manufacture utilizing metal coated basalt fiber.

BACKGROUND

In the process of completing an oil or gas well, a tubing string can be run downhole and used to communicate produced hydrocarbon fluids from a subsurface formation to the surface. Typically, this tubing string can be coupled to a screen assembly that controls and limits debris, such as gravel, sand, and other particulate matter, from entering the tubing string as the fluid passes through the screen assembly.

The screen assembly generally includes one or more screens with multiple entry points (or flow paths) at which the produced fluid (liquid and/or gas) passes through the screen(s). Each screen is generally cylindrical and can be positioned adjacent or in proximity to an inflow control device (ICD), which can regulate flow of the produced fluid after the produced fluid passes through a flow path of the screen. These flow paths can be small to facilitate filtering of the produced fluid as it flows through the screen into the tubing string. One or more of the screens may be metal. Because of the high flow rates experienced by the screens in certain wellbores, even these metal screens may become abraded over time from particulate matter flowing through the screen assembly. In addition, the small flow paths can be plugged by mud, debris, and various other materials in the wellbore, causing an increased pressure on the screens that if left unchecked could cause damage to the screens.

BRIEF DESCRIPTION OF THE DRAWINGS

Various embodiments of the present disclosure will be understood more fully from the detailed description given below and from the accompanying drawings of various embodiments of the disclosure. In the drawings, like reference numbers may indicate identical or functionally similar elements. Embodiments are described in detail hereinafter with reference to the accompanying FIGS., in which.

DETAILED DESCRIPTION OF THE DISCLOSURE

Generally, this disclosure provides a screen assembly for wellbore production that utilizes basalt fibers bonded with one another by a metal binder to form one or more cables or wire which are used in the formation of a screen that is deployed around a base pipe. The basalt fibers are coated with metal such that upon application of energy to the fibers, the metal forms a matrix that binds the basalt fibers together. In one or more embodiments, instead of basalt fibers, other metal coated non-metallic fibers may be utilized, such as ceramic fibers. In one embodiment, the screen assembly may include a screen constructed of a single cable formed of a plurality of metal coated fibers, where the single cable is wrapped around a based pipe to form a screen, while in other embodiments, the screen may be constructed of multiple cables, each formed as described, that are woven or welded or braided together, or otherwise engaged with one another to form a mesh. In some embodiments, the non-metallic fibers may be entwined with metallic fibers to form a cable. In other embodiments, the cable may have a cross-section that is substantially round, while in other embodiments, the cable may have a cross-section that is polygonal, such as for example, a keystone-shaped cross-section where a first group of non-metallic fibers longitudinally extend in a first row and a second group of basalt fibers longitudinally extend in a second row adjacent the first row, but where the first group of non-metallic fibers has a greater number of fibers than the second group. It will be appreciated that screen assemblies formed with cables or wire as described not only result in screens that are stronger based on the properties of the non-metallic fiber, but may also be thinner, such that flow area through a screen can be increased. The high flow rates that could erode wholly metallic wire screen assemblies are likely to have less of an impact on screen assemblies as described herein.

Figure 1:
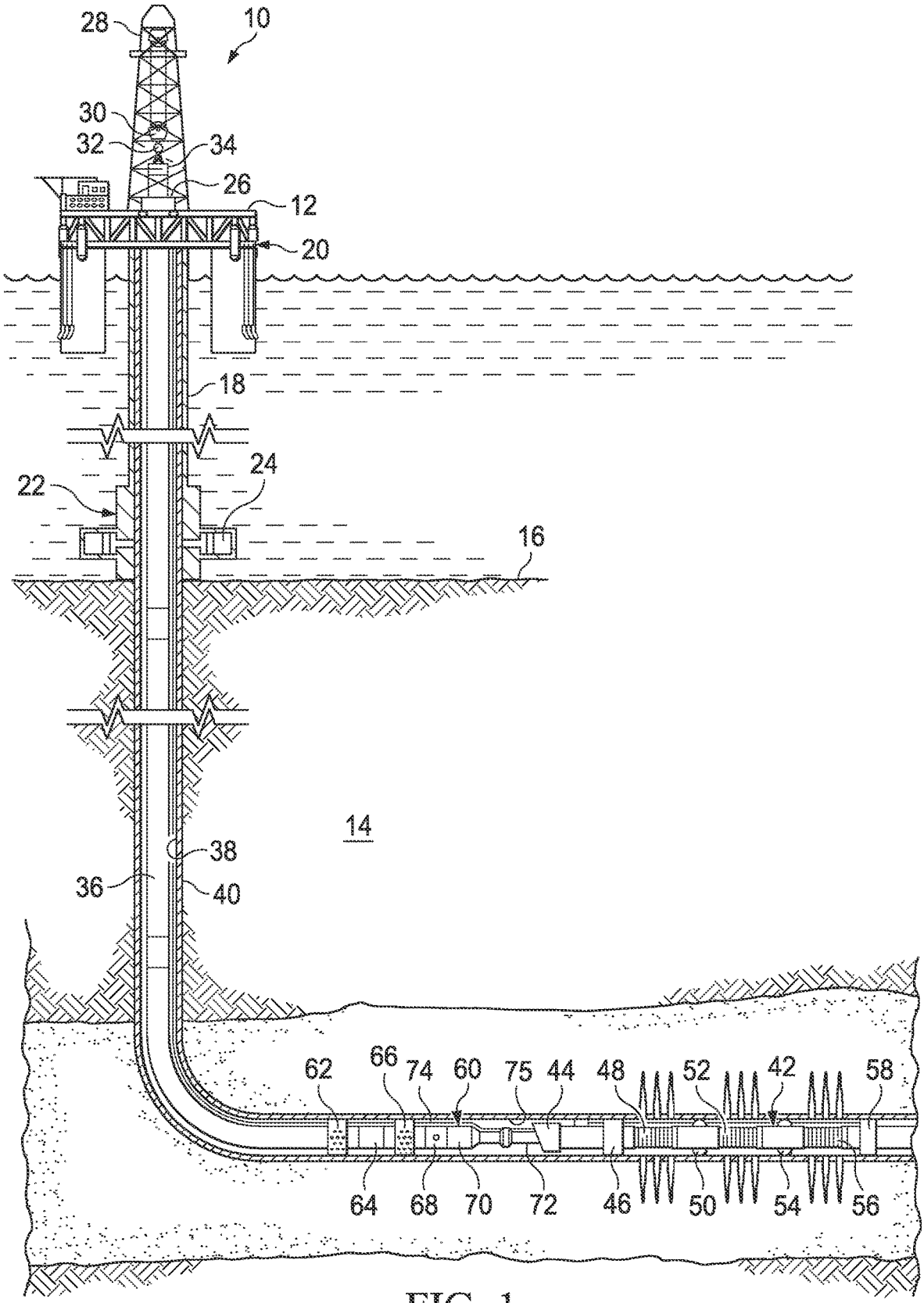
FIG. 1 is a representative partial cross-sectional view of a marine-based well system with one or more screen assemblies according to an embodiment, with the screen assemblies installed in a wellbore.

Referring to FIG. 1, a wellbore system 10 includes upper and lower completion assemblies 60, 42 installed in a wellbore 38. A semi-submersible platform 12 can be positioned over a submerged earthen formation 14 located below a sea floor 16. A subsea conduit 18 can extend from a deck 20 of the platform 12 to a subsea wellhead 22, including blowout preventers 24. The platform 12 can have a hoisting apparatus 26, a derrick 28, a travel block 30, a hook 32, and a swivel 34 for raising and lowering pipe strings, such as a substantially tubular, axially extending tubing string 36.

The wellbore 38 can extend through the earthen formation 14 and can have a casing cemented therein. The lower completion assembly 42 may be positioned in a substantially horizontal portion of the wellbore 38. The lower completion assembly 42 can include one or more screen assemblies 48, 52 and 56, and various other components, such as a latch subassembly 44, one or more packers 46 and 58, one or more centralizers 50 and 54, etc. The upper completion assembly 60 can be interconnected in the tubing string 36 and can include various components such as one or more packers 62 and 66, an expansion joint 64, a flow control module 68, an anchor assembly 70, a latch subassembly 72, etc. One or more communication cables (such as an electric cable 74 that passes through the packers 62, 66) may be provided and extend from the upper completion assembly 60 to the surface through an annulus 75. The latch subassembly 44 can couple to the latch subassembly 72, thereby coupling the upper and lower completion assemblies 42 together.

The screen assemblies 48, 52 and 56 can include wire or cable wound screen assemblies, perforated shrouds, wire mesh, etc. which allow wellbore fluids to pass through the screen assemblies 48, 52 and 56 but generally does not allow debris or gravel pack sand contained in the fluid to pass through.

Figure 2A:
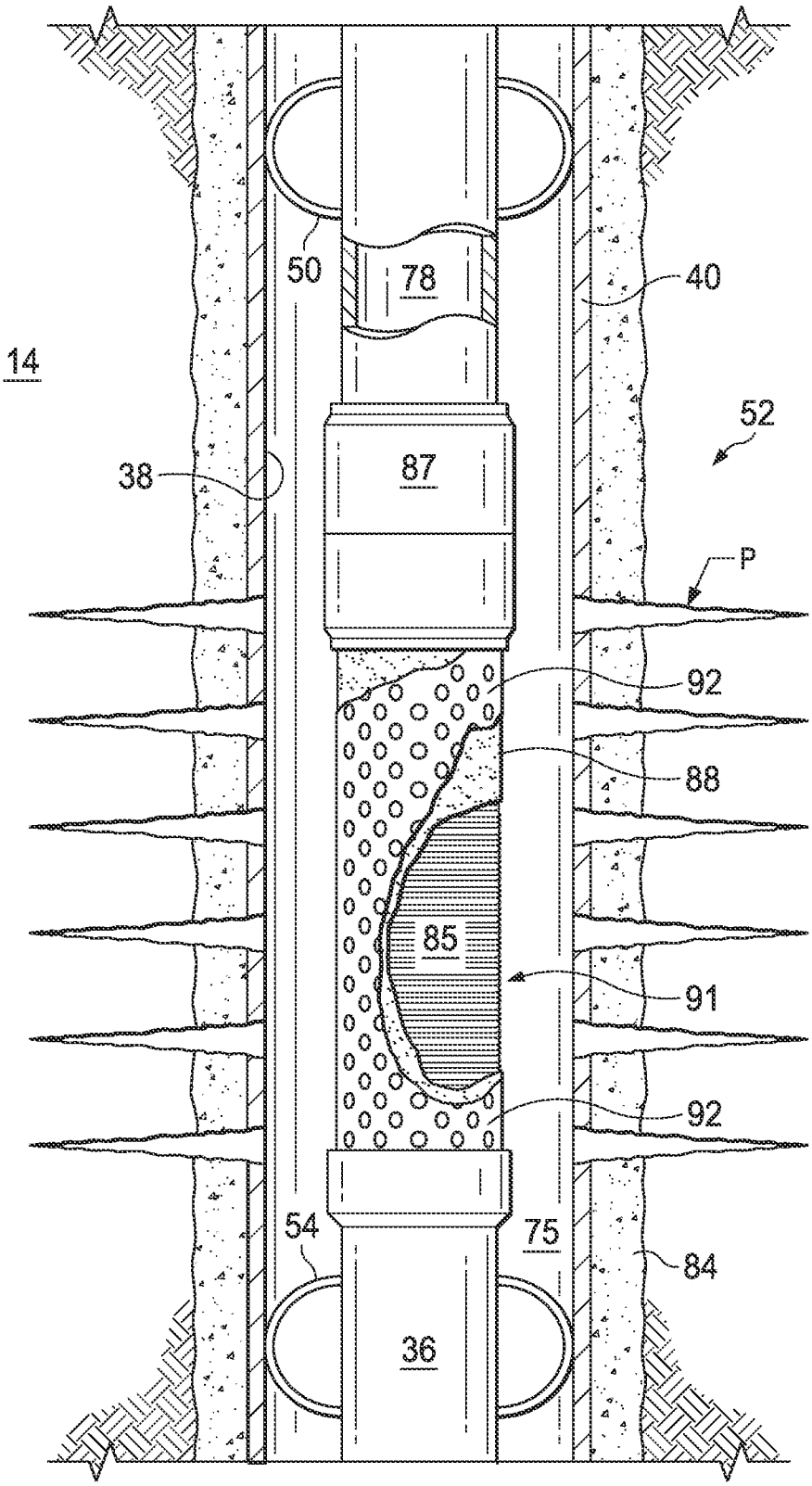
FIG. 2A is a representative partial cross-sectional view of an embodiment of a screen assembly, which can utilize principles of the present disclosure, positioned in a portion of the wellbore.

FIG. 2A shows a more detailed partial cross-sectional view of the screen assembly 52 after it has been installed in the wellbore 38. It should be understood that even though the screen assemblies 48 and 56 are not shown, this discussion regarding screen assembly 52 can also apply to them. The screen assembly 52 can be positioned adjacent perforations "P" that extend through the casing string 40, the cement 84, and into the earthen formation 14. The screen assembly 52 is interconnected in the tubing string 36 which includes an internal flow passage 78. The centralizers 50 and 54 can be used to maintain the screen assembly 52 proximate the center of the casing string 40. However, the centralizers 50 and 54 are not required. For example, one or more of the centralizers 50 and 54 can be absent, and/or replaced with a variety of packers or other equipment (not shown). The annulus 75 can be formed radially between the tubular string 36 and the casing string 40. A fluid can flow from the formation 14 into the annulus 75 and through the screen assembly 52 into the internal flow passage 78.

Figure 2B:
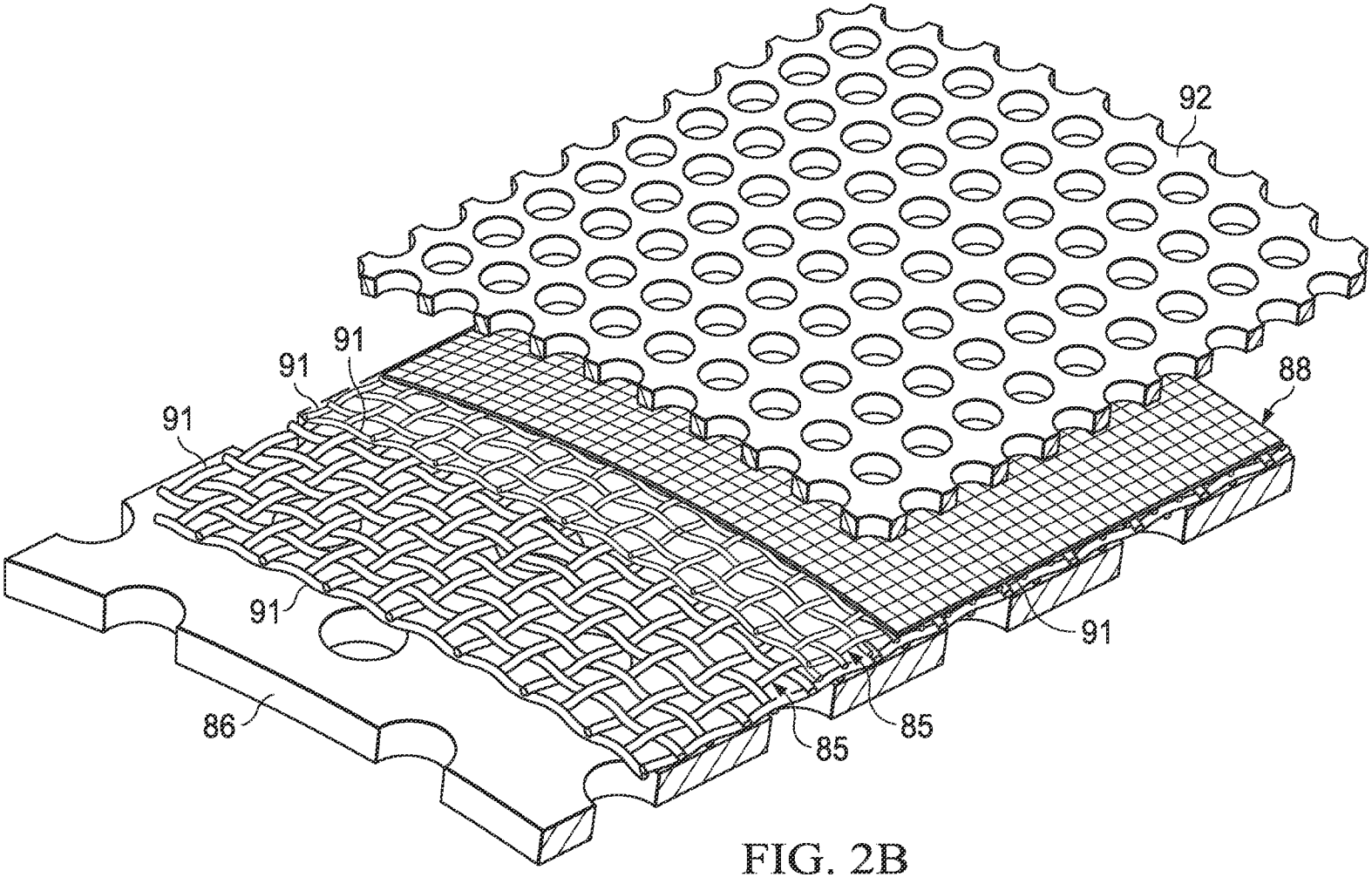
FIG. 2B is a perspective view of a portion of the screen assembly of FIG. 2A illustrating various layers that form the screen assembly.

Referring now to FIG. 2B, and with continued reference to FIG. 2A, the screen assembly 52 can include, in no particular order, one or more drainage layers 85, filter layers 88, and shrouds 92, as well as an inflow control device ("ICD") 87. The drainage layer 85 and filter layer 88 prevent or at least reduces the amount of debris, such as gravel, sand, and other particulate matter, from entering the interior flow passage 78. The fluid passing through the drainage layer can flow longitudinally between a base pipe 86 and drainage layer 85, through the ICD 87, and into the interior flow passage 78 for eventual production to the surface, and/or the fluid passing through the drainage layer 85 can flow along flow paths directly to the interior flow passage 78, as can be the case with a perforated base pipe 86. The perforated shroud 92 is shown in FIG. 2A in a cut-away view that allows the drainage layer 85 and filter layer 88 underneath to be seen. However, it should be clear that the perforated shroud 92 generally extends the length of the drainage layer 85 and filter layer 88 and surrounds these layers. FIG. 2A generally illustrates a screen assembly where a wire or cable 91 is wrapped around base pipe 86 as a base drainage layer with one or more additional mesh layers, such as filter layer 88 while FIG. 2B generally illustrates a screen assembly in which wires or cables 91 are woven, welded or otherwise secured together to form a mesh that can make up the various layers 85, 88. In one or more embodiments as illustrated, the screens of the various layers 85, 88 may become progressively coarser or finer from the outer layer to the inner layer. In other embodiments, various screen assemblies described herein may be utilized during injection of fluid into the formation during wellbore production or other hydrocarbon drilling and production activities, such as filtering fluid produced from the wellbore 38. For the avoidance of doubt, the wires or cables 91 described herein can be used to fabricate one or more of the screen assembly layers, such as drainage layer 85 and/or filter layer 88.

Figure 3A:
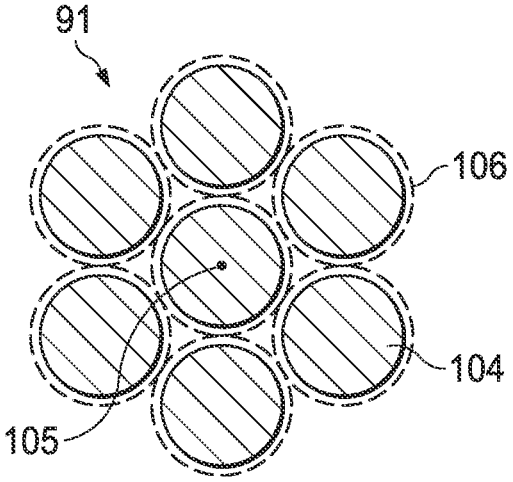
FIG. 3A a representative partial cross-sectional view of one embodiment of a cable formed of metal coated fibers for use in a downhole screen assembly.

Turning to FIG. 3A, shown is one embodiment of a wire or cable 91 as described above. In this embodiment, a cable 91 is formed of a plurality of non-metallic fibers 104 about a primary cable axis 105. In one or more embodiments, the non-metallic fibers 104 are basalt fiber. In any event, the non-metallic fibers are coated with a metal 106. While cable 91 in this embodiment is shown as having a generally circular cross-section about primary cable axis 105, cable 91 is not limited to a particular shape.

Figure 3B:
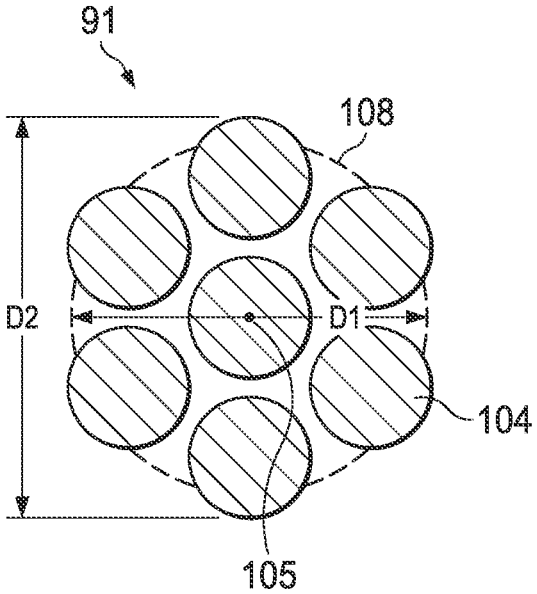
FIG. 3B is a representative partial cross-sectional view of an embodiment of a composite cable formed of fibers and a metal binder for use in a downhole a screen assembly.

In FIG. 3B, another embodiment of cable 91 is shown, wherein a metal matrix 108 binds non-metallic fibers 104 to one another. In one or more embodiments, energy can be applied to the metal coating 106 of the fibers 104 shown in FIG. 3A, sintering, melting or softening the metal coating 106 to form the metal matrix 108 shown in FIG. 3B. In another embodiment, the energy is a compression force applied to the metal coating 106 of the fibers 104 to form the metal matrix 108. In one or more embodiments, the metal matrix 108 of cable 91 has a diameter D1 that is less than the diameter D2 of the overall cable 91 such that non-metallic fibers 104 are exposed about the perimeter of cable 91, where the radii D1 and D2 are relative to the primary cable axis 105. In this way, as formation fluid flow passes across cable 91, sediment is more likely to impinge upon the exposed non-metallic fibers 104 and less likely to impinge upon the metal matrix 108.

Figure 3C:
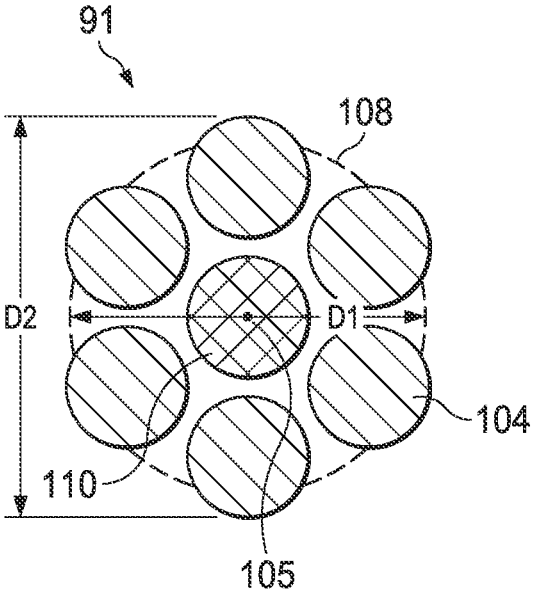
FIG. 3C is a representative partial cross-sectional view of another embodiment of a composite cable formed of a metal core surrounded by basalt fibers for use in a downhole the screen assembly.

FIG. 3C illustrates an embodiment similar to the embodiment of FIG. 3B, but where cable 91 is formed of at least a plurality of first fibers 104 and one or more second fibers 110 extending along primary cable axis 105. Second fiber(s) 110 may likewise be non-metallic, with or without the metal coating 106 shown in FIG. 3A. In one or more embodiments, a plurality of second fibers 110 may be provided which may be intertwined, braided or otherwise engaged with the first fibers 104. In other embodiments, one or more second fibers 110 may form a core of cable 91 about which the first fibers 104 are deployed, such as is shown in the illustrated embodiment of FIG. 3C. Second fiber(s) 110 may be metallic or may be fiber optic. For example, in FIG. 3C, second fiber 110 at the core of cable 91 is metallic, while first fibers 104 are non-metallic about the periphery of cable 91. Alternatively in FIG. 3C, second fiber 110 at the core of cable 91 is an optical fiber, while first fibers 104 are non-metallic about the periphery of cable 91. In one or more embodiments where second fiber 110 is an optical fiber, second fiber can be utilized to measure the condition of a screen assembly 52 when deployed downhole.

Although in some embodiments, the non-metallic fibers 104 have been described as basalt fiber, in other embodiments, the non-metallic fibers 104 may be formed of other materials including without limitation carbon fiber, alumina fiber, carbide fiber, quartz fiber, glass fiber, aramid fiber, boron, polyester, liquid crystal polymer, or silicon. Likewise, as described above, different types of non-metallic fibers may be combined and bound together by the metal matrix 108. For example, a mesh can be created with basalt fibers in one direction and carbon fibers in the other (warp and weft directions). In another example, the mesh can be created with a combination of ceramic fibers and polymer fibers.

With regard to the metal matrix 108, in one or more embodiments, the metal matrix 108 is formed by causing the metal coating 106 of the individual fibers 104, 110 to bond the fibers 104, 110 to one another. However, in other embodiments, the non-metallic fibers 104 and/or second fibers 110 need not be metal coated, but the metal matrix 108 may be injected or otherwise formed around the non-metallic fibers 104 and/or second fibers 110 in another method. In any event, metal matrix 108 is not limited to a particular type of metal nor is the metal coating 106. In one or more embodiments, metal matrix 108 or metal coating 106 on the non-metallic fibers 104 may be aluminum, nickel, copper, chromium, iron, tungsten, zirconium, palladium, tin, magnesium, zinc, and alloys that contain those metals or oxides of those metals. In one example the non-metallic fibers 104 are coated with an electroless coating during formation of the fibers and in another example the non-metallic fibers 104 are coated with an electroplating process. In this plating process, multiple layers of pre-treatment can be used to aid the adhesion of the metal to the non-metallic fibers. The pre-treatment steps can include a sequence of sensitizing (such as with an acetic acid or stannous chloride) as well as a sequence of activation (such as with palladium chloride or HCl) prior to the step of metallization (such as with copper sulfate for a copper coating). In some cases, an electroless nickel coating is needed before the final step of metallization in order to promote adhesion of the final metal coating. In another embodiment, the non-metallic fiber can be co-fired with a metal, especially a low-resistance metal like copper and silver.

In one example, a nickel-coated carbon fiber may be used form cable 91. The tensile strength of a 7-micron diameter fiber exceeds 360 ksi. This tensile strength is 3 to 6 times the strength of steel, which allows for a thinner cable 91 to be used in screen formation while maintaining the same burst strength as prior art screens. A stronger mesh may allow for a thinner or more open area shroud while maintaining the same burst strength. Alternatively, thinner, stronger cables may permit minimizing or eliminating one or more drainage layers in a screen assembly.

In another example, a copper-coated basalt fiber is used. A 15-micron diameter fiber has a tensile strength of 335 ksi.

Tensile strength of the fibers 104 may be further enhanced by providing a non-metallic fiber 104 with amorphous areas, such as for example, adjacent the outer radius of the non-metallic fiber 104. Thus, a non-metallic fiber 104 may have a first molecular structure at a first diameter and a second molecular structure at a second diameter larger than the first diameter where the first molecular structure is crystalline solid and the second molecular structure is non-crystalline solid. In some cases, this combination of non-crystalline and amorphous areas can place the parts of the fiber in compression. In other cases, the combination of non-crystalline and amorphous areas increases the toughness of the fiber. It will be appreciated that this non-crystalline or amorphous area of the fiber 104 is important for increasing the operational strength of the fiber.

Figure 4A:
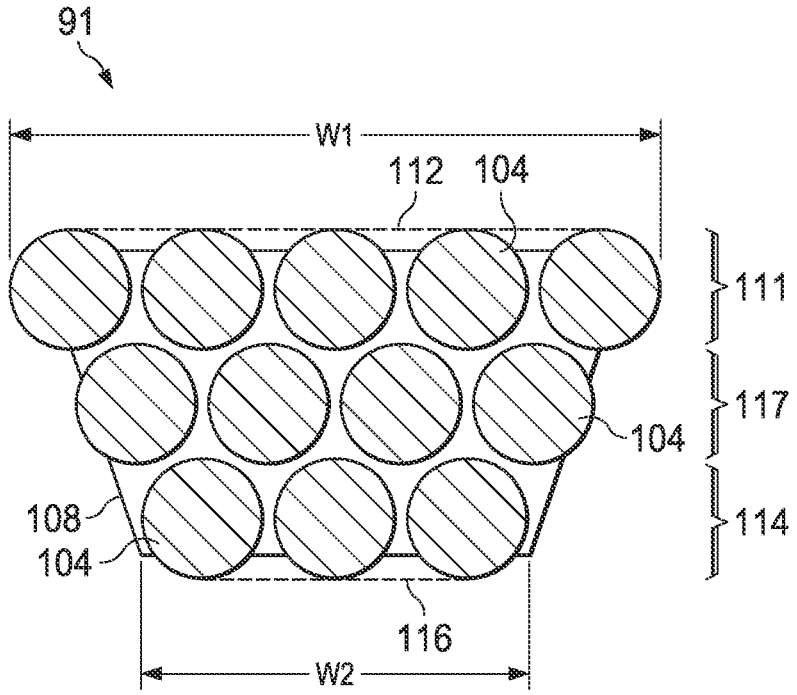
FIG. 4A is a representative partial cross-sectional view of keystone-shaped cable formed of metal-coated, non-metallic fibers.

FIG. 4A illustrates another embodiment of cable 91, wherein the cable 91 has a polygonal cross-section. Although not limited to a particular polygonal shape, in the illustrated embodiment, the cross-section of cable 91 is keystone shaped. As such, cable 91 has a first group of non-metallic fibers 111 at an outer periphery 112 of cable 91 and a second group of fibers 114 at an inner periphery 116 of cable 91, where the first and second groups of fibers 111, 114 generally extend longitudinally relative to one another. The first group of fibers 111 are general disposed in a first row or plane and characterized by a first width W1, and the second group of fibers 114 are generally disposed in a second row or plane and characterized by a second width W2, where the first and second rows or planes are generally parallel with one another. The first width W1 is wider than the second width W2. In this regard, where all of the fibers of the first group of fibers 111 and the second group of fibers 114 are of substantially the same diameter, the first group of fibers 111 will have a greater number of fibers than the second group of fibers 114. In any event, a metal matrix 108 bonds, secures or otherwise engages the fibers 104 to one another.

Figure 4B:
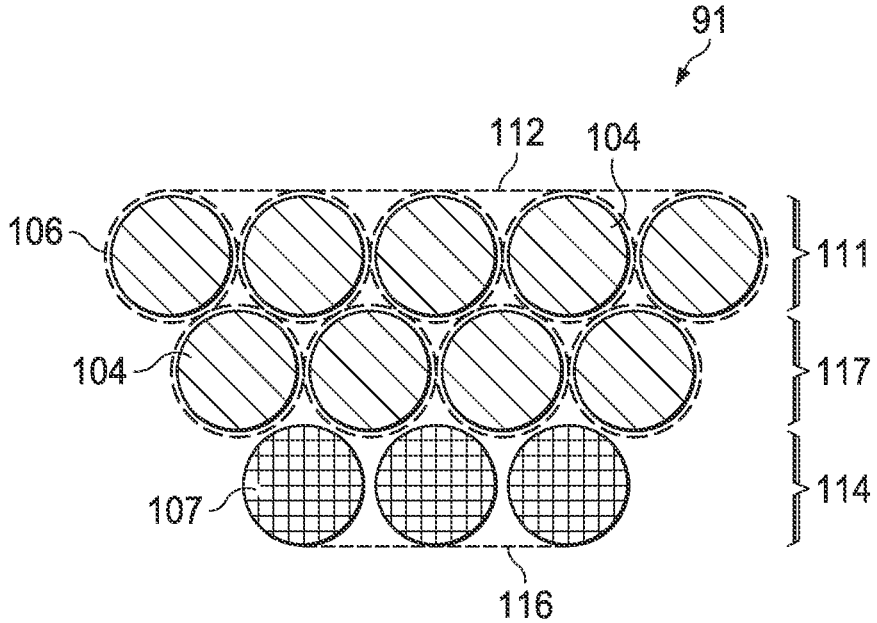
FIG. 4B is a representative partial cross-sectional view of a keystone-shaped cable formed of metal-coated, non-metallic fibers and metal fibers.
Figure 5:
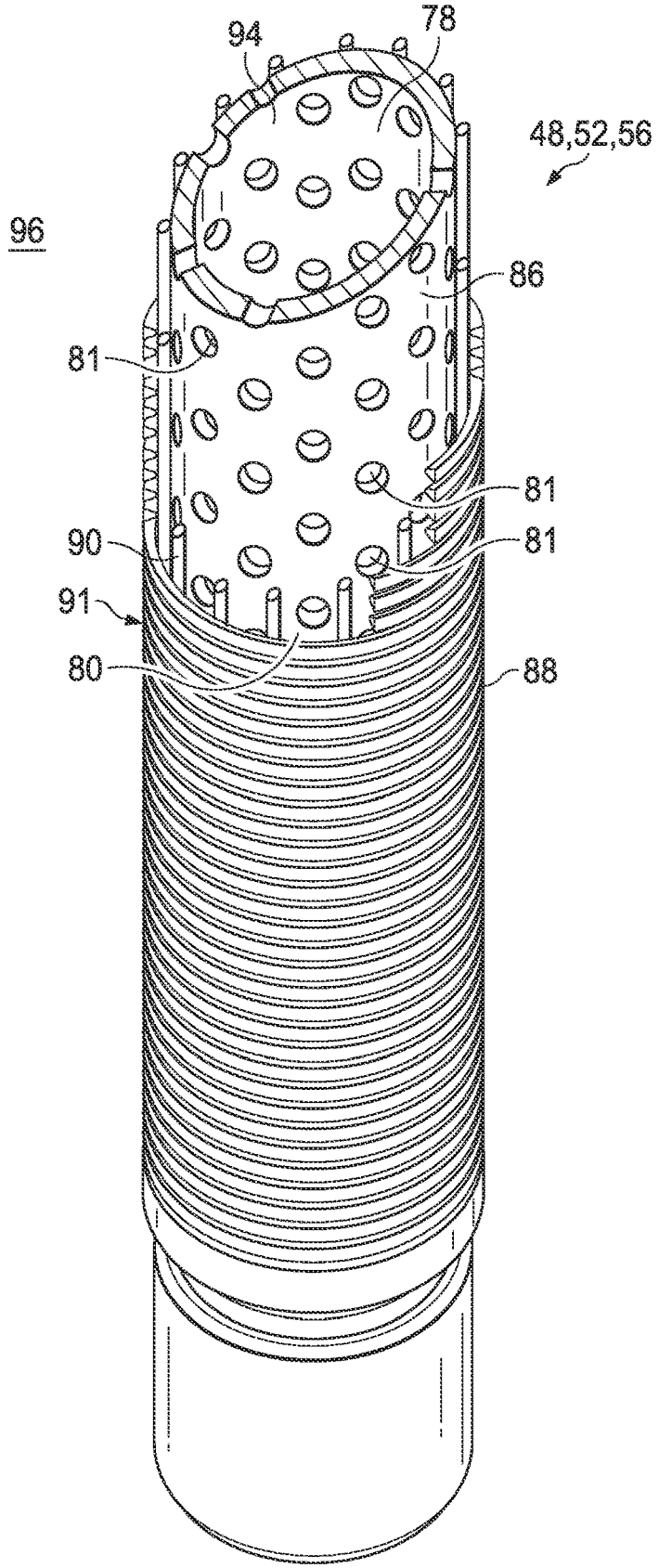
FIG. 5 is a representative partial cross-sectional view of another embodiment of a screen assembly illustrating a cable wrapped around a base pipe.

In addition to the first group of fibers 111 and the second group of fibers 114, additional groups of fibers 117 may be disposed between the inner periphery 116 and the outer periphery 112 of cable 91 and similarly arranged as described above. Thus, as shown in FIG. 4A, a group of non-metallic fibers 111 longitudinally disposed in a first row; a group of fibers 117 are longitudinally disposed in a second row and positioned adjacent the first row; and a group of fibers 114 longitudinally disposed in a third row and positioned adjacent the second row, wherein the first group of non-metallic fibers 111 has a greater number of fibers than the group of fibers 117 and the group of fibers 117 has a greater number of fibers than the group of fibers 114. In one or more embodiments, the fibers of all groups of fibers 111, 114, 117 may be the same, such as for example, basalt fibers coated with metal 106, while in other embodiments, the groups of fibers other than the first group of fibers 111 may be either non-metallic or metallic. In the embodiment of FIG. 4B, for example, the group of fibers 111 and the group of fibers 117 are shown as being non-metallic fibers 104 with metal coating 106, while the group of fibers 114 is shown as being a metallic fiber 107. It will be appreciated that the embodiment of FIG. 4B, where the third group of fibers 118 are metallic fibers, these metallic fibers can be utilized to weld cable 91 to supports 90 as shown in FIG. 5. In other embodiments, metallic fibers can be sandwiched between non-metallic fibers since the outermost edges of the cable are what experience the most erosive velocities.

With reference to FIG. 5, a cable 91 such as is described in FIGS. 4A and 4B is shown in an embodiment of screen assemblies 48, 52, 56. The screen assembly 48, 52, 56 can include a perforated base pipe 86 with supports 90 positioned on an exterior surface of the base pipe 86, and with wire or cable 91 wrapped around the supports 90 to form the filter layer 88. Channels in a drainage layer 80 formed by the supports 90 can be formed between the base pipe 86 and the wrapped cable 91 to allow fluid to flow through the filter layer 88, possibly along an exterior of the base pipe 86, and through a perforation of the base pipe 86 into the interior flow passage 78. Flow paths 81, which can provide radial fluid flow through the screen assembly 48, 52, 56, extend from an exterior 96 of the screen assembly 48, 52, 56, through spaces between adjacent wire wraps of the drainage layer 85 and extending through perforations in the base pipe 86 into an interior 94 of the screen assembly 48, 52, 56. Flow paths 81 would also be included in other layers in addition to those shown in FIG. 5, such as a shroud 92, drainage layer 85 (see FIG. 2A).

Figure 6:
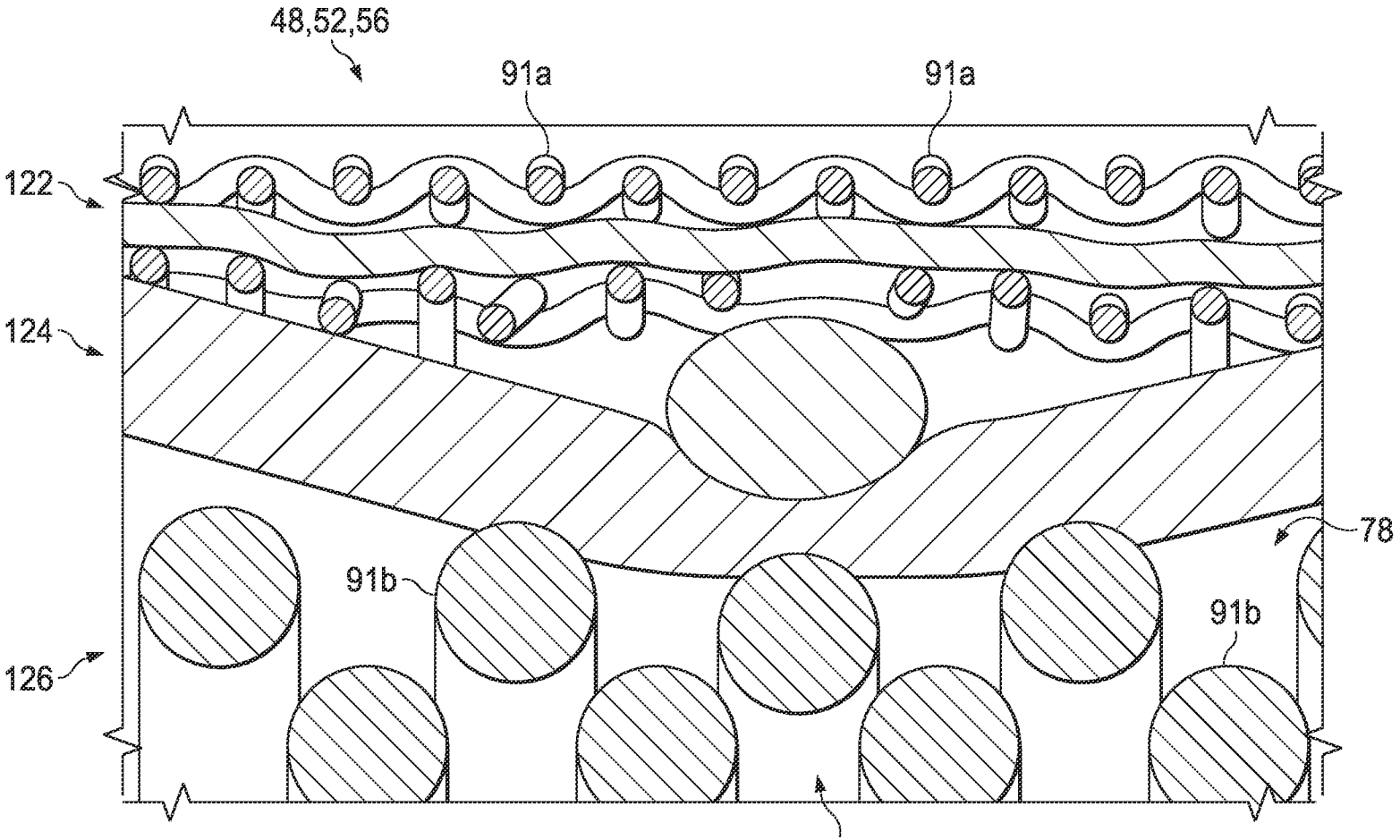
FIG. 6 is a representative cross-sectional view of layers forming an embodiment of a screen assembly.

FIG. 6 shows a detailed view of another example embodiment of the screen assemblies 48, 52 and 56 as described above. Specifically shown is a screen assembly with various layers 122, 124 and 126. In one embodiment, the layers 122, 124, 126 may become progressively coarser from an outer layer to an inner layer (closest to the base pipe (see FIG. 5). In the illustrated embodiment, filter layer 122 is bonded with multiple progressively coarser layers 124, 126 to help ensure superior sand retention, fluid drainage and/or collapse resistance. As can be seen the cable 91*a* that make up the filter layer 122 are of a much smaller diameter than the cables 91*b* of the inner layers 124, 126. In this regard, the non-metallic fibers that make up the cables 91*a*, 91*b* likewise may have different diameters that become progressively larger from the exterior 96 (FIG. to interior 94 of screen assemblies 48, 52 and 56. The cables 91*a*, 91*b* may include cables constructed as any of the cables 91 described above with reference to FIGS. 3A-3C, for example. The screen assembly 48, 52, 56 can include a portion of the flow passage 78 through the interior 94 of the screen assembly 48, 52 and 56.

It will be appreciated that for any of the embodiments described herein, the metal coating 106 on the fiber 104 may be a coating "in the green state". The coating is considered to be in the green state when it is a pre-mixed powder. The powder can be compacted to the fiber 104 prior to the formation of the cable 91 or after the cable 91 is formed. Compaction typically uses to 100 psi compressive force. Thereafter, the cable 91 with the green-state metal coating 106 can be sintered at high temperature. The compacted particles bond together and form a strong bond. In one or more embodiments, the sintering temperature can range from 1000F to 2500F with most operations near 2000F.

As described, screens are created from a cable 91 composed of non-metallic fibers bound by a metal matrix. The cable 91 is created by bonding non-metallic fibers together with metal. The result is a cable 91 that is both stronger and harder than prior art cables, making sand screens formed of the cable more erosion resistant and allowing thinner cables than metal screens of the prior art. The thinner cable formed as described also have the benefit of increasing flow area without sacrificing strength.

In one or more embodiments, ceramic fibers described herein are all-ceramic, while in other embodiments, ceramic fibers may be mixed metal-ceramic composite. A ceramic fiber is desirable because there is a greater fraction of the harder, more erosion resistant ceramic material. All ceramic fibers are especially attractive to a mesh configuration shown in FIG. 2B but can be used in other configurations like wire wrap of FIG. 5. A composite of metal and ceramic may be desirable because the metal provides additional mechanical toughness over ceramic alone. The composite construction can be used in either the mesh configuration of FIG. 2B or in the wire wrap configuration of FIG. 5.

Thus, a screen assembly for wellbore production has been described. Embodiments of the screen assembly may generally include a base pipe and at least one screen disposed around the base pipe, wherein the at least one screen is formed of one or more cables comprising a plurality of basalt fibers bonded with one another by a metal binder. Other embodiments of the screen assembly may include a base pipe and at least one screen disposed around the base pipe, wherein the at least one screen is formed of one or more cables comprising a plurality of basalt fibers each having a metal coating. Other embodiments of the screen assembly may include a base pipe and at least one screen disposed around the base pipe, wherein the at least one screen is formed of one or more cables comprising a plurality of basalt fibers disposed around a metal core. Other embodiments of the screen assembly may include a base pipe and at least one screen disposed around the base pipe, wherein the at least one screen is formed of one or more cables comprising a plurality of non-metallic fibers bonded with one another by a metal binder. Other embodiments of the screen assembly may include a base pipe and at least one screen disposed around the base pipe, wherein the at least one screen is formed of one or more cables comprising a plurality of non-metallic fibers each having a metal coating. Other embodiments of the screen assembly may include at least one screen, wherein the at least one screen is formed of one or more cables comprising a plurality of basalt fibers bonded with one another by a metal binder. Other embodiments of the screen assembly may include at least one screen, wherein the at least one screen is formed of one or more cables comprising a plurality of basalt fibers each having a metal coating. Other embodiments of the screen assembly may include at least one screen, wherein the at least one screen is formed of one or more cables comprising a plurality of basalt fibers disposed around a metal core. Other embodiments of the screen assembly may include at least one screen, wherein the at least one screen is formed of one or more cables comprising a plurality of non-metallic fibers bonded with one another by a metal binder. Other embodiments of the screen assembly may include at least one screen, wherein the at least one screen is formed of one or more cables comprising a plurality of non-metallic fibers each having a metal coating.

For any of the foregoing embodiments, the screen assembly may include any one of the following elements, alone or in combination with each other:

- the base pipe has one or more apertures formed therein.
- the non-metallic fibers are ceramic fibers.
- the non-metallic fibers are nickel-coated carbon fiber.
- the non-metallic fibers are copper-coated basalt fiber
- the non-metallic fibers are selected from the group consisting of carbon fiber, alumina fiber, carbide fiber, quartz fiber, glass fiber, aramid fiber, silicon fiber.
- wherein the non-metallic fibers comprise a first fiber and a second fiber different from the first fiber.
- the first fiber runs in a first direction and the second fiber runs in a second direction different from the first direction.
- the first fiber is the warp direction and the second direction different is the weft direction.
- the metal coating is selected from the group consisting of aluminum, nickel, copper, chromium, iron, tungsten, zirconium, palladium, tin, alloys that contain those metals and oxides of those metals.
- the ceramic fibers are basalt fibers.
- the one or more cables has a circular cross-section.
- the plurality of basalt fibers are radially disposed around a primary cable axis.
- the one or more cables has a keystone cross-section.
- the one or more cables has a substantially round cross-section.
- the one or more cables has a polygonal cross-section.
- the one or more cables comprises a first group of basalt fibers longitudinally disposed in a first row; and a second group of basalt fibers longitudinally disposed in a second row and positioned adjacent the first row; wherein the first group of basalt fibers has a greater number of basalt fibers than the second group.

the one or more cables comprises a first group of basalt fibers longitudinally disposed in a first row; a second group of basalt fibers longitudinally disposed in a second row and positioned adjacent the first row; and a third group of basalt fibers longitudinally disposed in a third row and positioned adjacent the second row; wherein the first group of basalt fibers has a greater number of basalt fibers than the second group; and the second group of basalt fibers has a greater number of basalt fibers than the third group.

the first group of basalt fibers, the second group of basalt fibers and the third group of basalt fibers are bonded with one another by a metal binder.

the plurality of basalt fibers extend linearly relative to the primary cable axis.

the plurality of basalt fibers spiral around the primary cable axis.

the plurality of basalt fibers are interwoven with one another around the primary cable axis.

the plurality of basalt fibers are braided together.

the plurality of basalt fibers are braided together with one or more metal fibers.

one or more metal fibers.

the one or more metal fibers are disposed radially inward of the basalt fibers.

the one or more metal fibers are disposed radially inward of the non-metal fibers.

the one or more metal fibers are disposed radially inward of the ceramic fibers.

the one or more metal fibers are disposed along the cable axis forming a cable core.

the metal matrix extends to a first diameter and the non-metallic fibers extend to a second diameter greater than the first diameter.

the metal binder encases only a portion of each of the plurality of the basalt fibers.

the metal binder is disposed along only a portion of the outer surface of each basalt fiber.

the one or more cables comprises a first group of fibers longitudinally disposed in a first row; and a second group of fibers longitudinally disposed in a second row and positioned adjacent the first row; wherein the first group of fibers are basalt fibers and the second group of fibers are metallic fibers; and wherein the first group of fibers has a greater number of fibers than the second group of fibers.

the at least one screen comprises a drainage screen.

the at least one screen comprises a filter screen.

the at least one screen comprises an outer shroud.

the at least one screen comprises an outer shroud, the screen assembly further comprising a second screen, wherein the second screen is formed of one or more cables comprising a plurality of basalt fibers bonded with one another by a metal binder; and wherein the second screen is disposed about the base pipe radially inward from the outer shroud.

the one or more cables each have a first diameter and a second diameter smaller than the first diameter, wherein the fibers extend radially outward to the first diameter and the metal binder extends radially outward no further than the second diameter.

each of the plurality of basalt fibers comprises a first molecular structure at a first diameter and a second molecular structure at a second diameter larger than the first diameter.

the first molecular structure is crystalline solid and the second molecular structure is non-crystalline solid.

Additionally, a method of manufacturing a screen assembly for wellbore production has been described. Embodiments of the method may generally include providing a plurality of basalt fibers coated with metal; forming a cable utilizing the plurality of metal coated basalt fibers; and wrapping the cable around a base pipe to form a screen about the base pipe. Other embodiments of the method of manufacturing may include providing a plurality of basalt fibers coated with metal; and forming a cable utilizing the plurality of metal coated basalt fibers; wherein forming comprises arranging the basalt fibers adjacent one another to extend along the cable axis and applying energy to the metal coating to bind the basalt fibers to one another. Other embodiments of the method of manufacturing may include providing a multiplicity of basalt fibers coated with metal; forming a plurality of cable utilizing the multiplicity of metal coated basalt fibers; wherein each cable is formed by arranging the basalt fibers adjacent one another to extend along a cable axis and applying energy to the metal coating to bind the basalt fibers to one another; and weaving the plurality of the cables together to form a mesh screen. Other embodiments of the method of manufacturing may include providing a plurality of ceramic fibers coated with metal; forming a cable utilizing the plurality of metal coated ceramic fibers; and wrapping the cable around a base pipe to form a screen about the base pipe. Other embodiments of the method of manufacturing may include providing a plurality of ceramic fibers coated with metal; and forming a cable utilizing the plurality of metal coated ceramic fibers; wherein forming comprises arranging the ceramic fibers adjacent one another to extend along the cable axis and applying energy to the metal coating to bind the ceramic fibers to one another. Other embodiments of the method of manufacturing may include providing a multiplicity of non-metal fibers coated with metal; forming a plurality of cable utilizing the multiplicity of metal coated non-metal fibers; wherein each cable is formed by arranging the non-metal fibers adjacent one another to extend along a cable axis and applying energy to the metal coating to bind the non-metal fibers to one another; and weaving the plurality of the cables together to form a mesh screen.

For the foregoing embodiments, the method may include any one of the following steps, alone or in combination with each other:

providing comprises applying metal powder to the outer surface of a plurality of basalt fibers.

forming comprises arranging the basalt fibers adjacent one another to extend along the cable axis and applying energy to the metal coating to bind the basalt fibers to one another.

forming comprises arranging the basalt fibers adjacent one another to extend along the cable axis and applying energy to the metal coating to bind the basalt fibers to one another.

applying energy to the metal coating comprises heating the basalt fibers to melt the metal and form a metal binder to engage the basalt fibers with one another.

arranging the basalt fibers adjacent one another comprises weaving the basalt fibers together along a cable axis.

arranging the basalt fibers adjacent one another comprises spiraling the basalt fibers along a cable axis.

positing an additional fiber along the cable axis so as to be coaxial therewith.

the additional fiber is a metal coated basalt fiber.

the additional fiber is a metal fiber.

positing the plurality of ceramic fibers radially outward of one or more metal fibers extending along the cable axis.

wrapping a plurality of ceramic fibers around one or more metal fibers.

wrapping comprises weaving a plurality of the cables together to form a mesh screen and positioning the mesh screen round the base pipe.

the non-metal fiber is ceramic fiber.

the ceramic fiber is basalt fiber.

forming further comprises providing additional metal binder about the metal coated fibers to enhance bonding therebetween.

weaving further comprises applying energy to the woven cables to bind the cables to one another.

wrapping further comprises applying energy to the cable to the cables to bind the cable adjacent the base pipe.

utilizing the utilizing the metal binder to weld the cable around the base pipe.

forming comprises arranging a first group of basalt fibers longitudinally in a first row; arranging a second group of basalt fibers longitudinally in a second row and positioned adjacent the first row; wherein the first group of basalt fibers has a greater number of basalt fibers than the second group; and bonding the groups of basalt fibers together with one another by a metal binder.

forming comprises arranging a first group of basalt fibers longitudinally in a first row; arranging a second group of basalt fibers longitudinally in a second row and positioned adjacent the first row; and arranging a third group of basalt fibers longitudinally in a third row and positioned adjacent the second row; wherein the first group of basalt fibers has a greater number of basalt fibers than the second group; and the second group of basalt fibers has a greater number of basalt fibers than the third group; and bonding the groups of basalt fibers together with one another by a metal binder.

forming comprises arranging a first group of basalt fibers longitudinally in a first row; arranging a second group of metal fibers longitudinally in a second row and positioned adjacent the first row; wherein the first group of basalt fibers has a greater number of fibers than the second group of metal fibers; and bonding the groups of fibers together with one another by a metal binder.

wrapping the cable around a base pipe further comprises applying energy to the metal binder to weld the cable to axial drainage wires extending along the base pipe.

wrapping the cable around a base pipe further comprises applying energy to metal fibers within the cable to weld the cable to axial drainage wires extending along the base pipe.

providing a plurality of basalt fibers coated with metal comprises coating the basalt fibers with an electroless coating.

providing a plurality of basalt fibers coated with metal comprises coating the non-metallic fibers with an electroless coating.

coating a fiber with an electroless coating comprises applying metal coating to the fiber a sequence of sensitizing, activation, and metallization.

sensitizing is with an acetic acid or stannous chloride.

activation is with palladium chloride or HCl.

metallization is with copper sulfate.

Although various embodiments have been shown and described, the disclosure is not limited to such embodiments and will be understood to include all modifications and variations as would be apparent to one skilled in the art. Therefore, it should be understood that the disclosure is not intended to be limited to the particular forms disclosed; rather, the intention is to cover all modifications, equivalents, and alternatives falling within the spirit and scope of the disclosure as defined by the appended claims.

What is claimed is:

1. A screen assembly for wellbore production comprising a base pipe and at least one screen disposed around the base pipe, wherein the at least one screen is formed of one or more cables comprising a plurality of ceramic fibers each of the ceramic fibers having an individual metal coating surrounding the ceramic fiber.

2. The screen assembly of claim 1, wherein the ceramic fibers are selected from the group consisting of basalt fiber, carbon fiber, alumina fiber, carbide fiber, quartz fiber, glass fiber, aramid fiber and silicon fiber.

3. The screen assembly of claim 1, wherein the metal coating is selected from the group consisting of aluminum, nickel, copper, chromium, iron, tungsten, zirconium, palladium, tin, alloys that contain those metals and oxides of those metals.

4. The screen assembly of claim 1, further comprising a metal binder bonding the metallic coated fibers to one another.

5. The screen assembly of claim 1, wherein the cable is wrapped around the base pipe to form the screen.

6. The screen assembly of claim 1, wherein the ceramic fibers comprise a first fiber and a second fiber different from the first fiber; wherein the first fiber runs in a first direction and the second fiber runs in a second direction different from the first direction; and wherein the first direction is a warp direction and the second direction is a weft direction.

7. The screen assembly of claim 1, wherein the one or more cables has a keystone cross-section.

8. The screen assembly of claim 1, wherein the one or more cables comprises a first group of ceramic fibers longitudinally disposed in a first row; a second group of ceramic fibers longitudinally disposed in a second row and positioned adjacent the first row; and a third group of fibers longitudinally disposed in a third row and positioned adjacent the second row; wherein the first group of fibers has a greater number of fibers than the second group; and the second group of fibers has a greater number of fibers than the third group.

9. The screen assembly of claim 1, wherein the ceramic fibers are bonded to one another about a primary cable axis, wherein the cable further comprises one or more metal fibers; wherein the one or more metal fibers are disposed radially inward of the ceramic fibers about the primary cable axis.

10. The screen assembly of claim 1, wherein the plurality of ceramic fibers are basalt fibers, wherein the basalt fibers comprise a first molecular structure at a first diameter and a second molecular structure at a second diameter larger than the first diameter; and wherein the first molecular structure is crystalline solid and the second molecular structure is non-crystalline solid.

11. The screen assembly of claim 1, wherein the metal coating is applied to the ceramic fiber as a powder.

12. The screen assembly of claim 11, wherein the powdered metal coating is compacted around the ceramic fiber.

13. The screen assembly of claim 12, wherein the powdered metal coating is sintered after compaction.

14. The screen assembly of claim 1, wherein the base pipe comprises apertures.

15. The screen assembly of claim 1, wherein the ceramic fiber is a carbon fiber and the metal coating is nickel.

16. The screen assembly of claim 1, wherein the ceramic fiber is a basalt fiber and the metal coating is copper.

17. The screen assembly of claim 1, wherein the one or more cables has a substantially round cross-section.

18. The screen assembly of claim 1, wherein the one or more cables has a polygonal cross-section.

19. The screen assembly of claim 1, wherein the ceramic fiber is a ceramic-metal composite fiber.

20. The screen assembly of claim 1, wherein the ceramic fiber is sensitized prior to coating with the metal coating.

* * * * *